US005311929A

United States Patent [19]

Verret

[11] Patent Number: 5,311,929

[45] Date of Patent: May 17, 1994

[54] HEAT EXCHANGER FOR DUSTY ENVIRONMENT

[76] Inventor: Normand Verret, 68 P'Tiso Park, Edmundston, N. B. E3V 3X7, Canada

[21] Appl. No.: 93,663

[22] Filed: Jul. 20, 1993

[51] Int. Cl.[5] ..... F28G 1/08

[52] U.S. Cl. ..... 165/95; 165/94; 165/109.1; 15/104.05; 138/38

[58] Field of Search ..... 165/94, 95, 109.1; 15/104.05, 104.18; 122/379; 138/38

[56] References Cited

U.S. PATENT DOCUMENTS

| | | | |
|---|---|---|---|
| 172,302 | 1/1876 | Dean | 138/38 |
| 215,583 | 5/1879 | Dean | 138/38 |
| 1,015,831 | 1/1912 | Pielock et al. | 138/38 |
| 2,300,058 | 10/1942 | Osborn, Jr. et al. | 138/38 |
| 2,933,138 | 4/1960 | Brite | 15/104.18 |
| 3,018,831 | 1/1962 | Gist | 15/104.05 |
| 3,384,161 | 5/1968 | Malmstrom et al. | 165/94 |
| 3,762,464 | 10/1973 | Takahashi | 165/95 |
| 4,326,893 | 4/1982 | Clifford | 15/104.05 X |
| 4,583,585 | 4/1986 | Estienne et al. | 165/94 |
| 4,718,480 | 1/1988 | Kito et al. | 165/94 |
| 4,781,245 | 11/1988 | Freychet et al. | 165/94 |
| 4,794,980 | 1/1989 | Raisanen | 165/109.1 X |
| 4,825,940 | 5/1989 | Barroyer et al. | 165/84 |

FOREIGN PATENT DOCUMENTS

| | | | |
|---|---|---|---|
| 65303 | 3/1892 | Fed. Rep. of Germany | 165/95 |
| 617673 | 7/1978 | U.S.S.R. | 165/94 |

*Primary Examiner*—John Rivell
*Assistant Examiner*—L. R. Leo

[57] ABSTRACT

A heat exchanger for mixtures of air and solid particles, particularly for woodworking shops, poultry farms and industrial environments of the like. The heat exchanger comprises a bank of staggered tubes through which warm air is exhausted, a casing with baffles enclosing the bank of tubes such that fresh air is forced between tubes in two or more successive passes, a series of cone-scrapper assemblies equally spaced on a rod inside each tube, and a pull frame connecting all rods, for reciprocating all scrapers in harmony.

9 Claims, 5 Drawing Sheets

HEAT EXCHANGER FOR DUSTY ENVIRONMENT

BACKGROUND OF THE INVENTION

The invention relates to heat exchangers for mixtures of air and solid particles, particularly for woodworking shops, paint shops, poultry farms and industrial environments of the like.

The rate of heat transmission in an air-to-air heat exchanger is generally higher for air flowing in a turbulent motion than for air flowing in laminar or streamline motion. The type of air flow inside a tube is defined mainly by the velocity of the air, the size and length of tubes and by the presence of deflectors inside the tube.

The rate of heat transmission in a heat exchanger is also depending upon the coefficient of heat transfer through the wall of the tubes. The heat transfer capacity of dust being much less than for metal, any thickness of dirt deposit inside the tubes does adversely affect the efficiency of the exchanger.

A common fact with industrial air-to-air heat exchanger is that the inside surface of the tubes requires frequent cleaning to maintain an acceptable efficiency. Hence, without a stringent maintenance program, the economic viability of the unit is often unsure.

A common fact with industrial heat exchangers is that replaceable filters are installed at the inlet end of the exchanger to filter dust particles from the incoming air. The inconvenience of filters is that the amount of dust particles collected reduce the air flow proportionally.

Another common fact with industrial heat exchangers is that, despite the use of filters, deflectors to increase turbulence inside the tubes are not used, because of a possible accumulation of dirt on the deflectors, and a resulting premature loss of efficiency.

Therefore, the high cost of maintenance, the reduced air flow periods between filter changes, and the absence of deflectors inside the tubes are the main causes for poor economic and physical performance of industrial air-to-air heat exchangers.

SUMMARY OF THE INVENTION

It is an object of this invention to provide an air-to-air heat exchanger, having a series of cone deflectors to generate turbulence inside the tubes, and having a series of scrapers for cleaning the inside surface of the tubes, in order to maintain ideal thermal conductivity in dusty environments.

It is further another object of this invention to provide scrapers which expand on the pull stroke and contract on the push stroke, thereby providing the means to convey dirt outside the tubes by successively overlapping the stroke of adjacent upstream scrapers.

Accordingly, the heat exchanger comprises a bank of staggered tubes through which warm air is blown, a casing with baffles enclosing the bank of tubes such that fresh air is forced between tubes in two or more successive passes, a series of cone-scraper assemblies equally spaced on a rod inside each tube, and a pull frame connecting all rods, for reciprocating all scrapers in harmony.

The shape and spacing of the cones deflect the flow of air repeatedly towards the inside surface of the tube, thereby causing an effect of pulsation, improving turbulence and hence heat transmission.

Each scraper comprises four wires and a pivot disc. Each wire has a portion bent according to the curvature of one quarter of the tube, and another portion bent sharply and extending radially towards the central rod. Each radial stem is pivotally retained, and spaced at 90°, within the pivot disc.

The turning of the wires within the pivot disc causes the scraping portion of all wires to expand against the surface of the tube when the scraper is pulled in the direction of the air flow.

Each wire has a tail end to overlap over the sharp bent or shoulder of the next wire such that all four wires interlock in the expanding direction.

The turning of the wires within the pivot disc causes the scraping portion of the wires to withdraw towards the centre of the tube when the scraper is pushed against the air flow.

When a series of scrapers are installed on a common rod, and their spacing is shorter than their stroke, the action of expanding and withdrawing the scraping portion causes a scraper to pass over dirt deposit left by the adjacent upstream scraper during the push motion only. Therefore, deposits removed from anywhere in the tube are eventually ejected at the outlet end of the exchanger.

The cleaning of the tube therefrom, and the turbulence promoted by the cones ensure continuous maximum efficiency of the exchanger.

A preferred embodiment of the invention will now be described by way of examples with reference to the accompanying drawings.

A BRIEF DESCRIPTION OF THE DRAWINGS

The accompanying drawings, which are incorporated in and form a part of the specification, illustrate the invention and, together with the detailed description, serve to explain the principles of the invention. In the drawings.

DETAILED DESCRIPTION OF THE INVENTION

Figure 1:
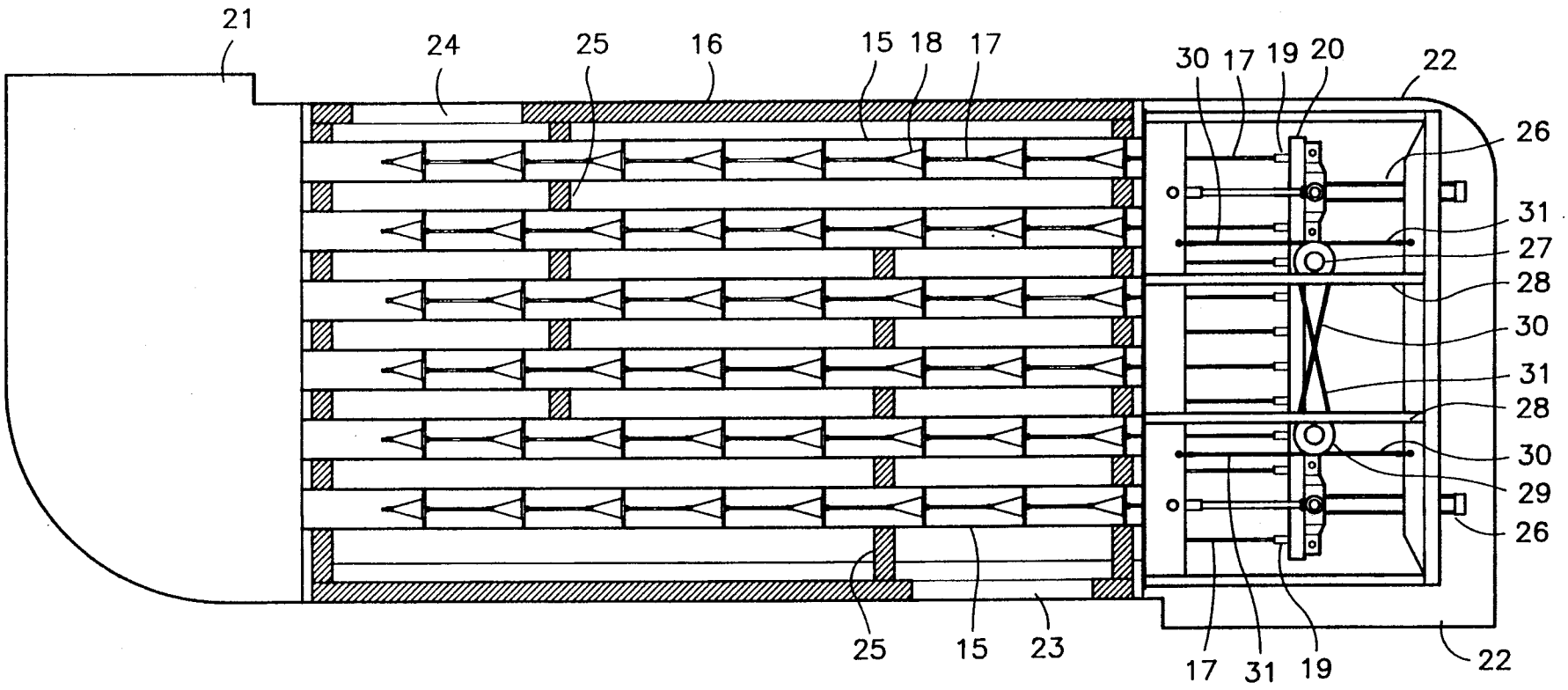
FIG. 1 shows a cross section of a heat exchanger. It illustrates the arrangement of the cones and scrapers within the tubes, and the arrangement of the pull frame inside the exhaust hood.

Referring to FIG. 1, the heat exchanger comprises a bank of staggered tubes 15, a casing 16, a series of cone-scraper assemblies 18 mounted on a common rod 17 within each tube 15, and a pull frame 20 connecting all rods 17 within a series of connectors 19 for reciprocating all cone-scraper assemblies 18 in harmony.

The casing 16 comprises a warm air inlet duct 21, a warm air outlet hood 22, fresh air inlet opening 23, fresh air outlet opening 24, and one or more baffle 25 to divert fresh air between tubes 15 in two or more successive passes.

The pull frame 20 is contained within the outlet hood 22 for a horizontal installation as shown on FIG. 1. In case of a vertical installation, the pull frame 20 would be installed atop the unit, inside the warm air inlet duct 21.

The pull frame 20 is activated back and forth by hydraulic cylinders 26. The alignment of the pull frame 20 is maintained by four wheels 27 rolling against four bars 28 extending longitudinally within the outlet hood 22. A system of pulleys 29 mounted adjacent to each wheels 27, and two pairs of cables 30, 31 maintain the pull frame 20 perpendicular to its axis of displacement.

Figure 2:
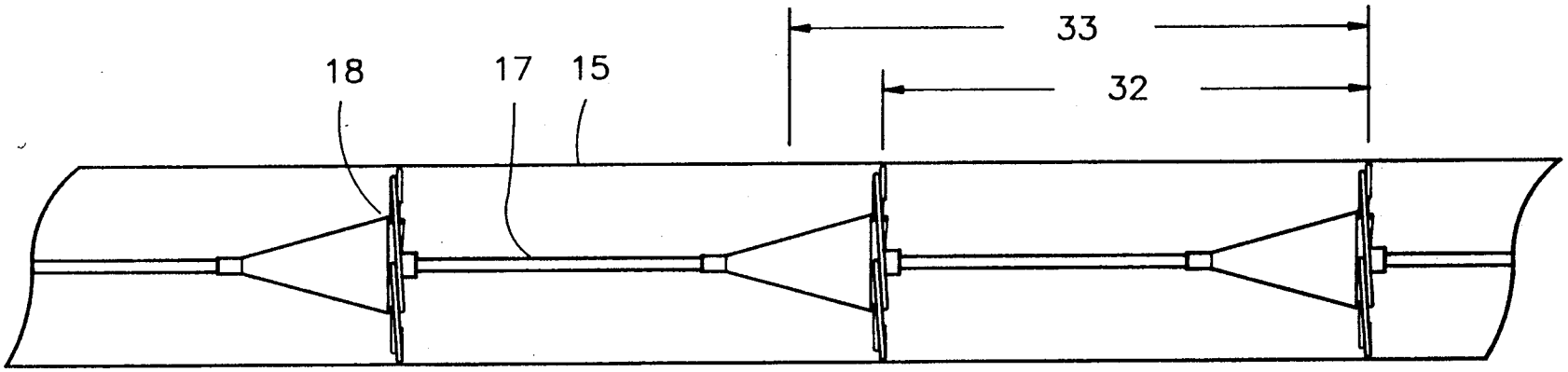
FIG. 2 illustrates the position of the scrapers when the rod is pulled in the air flow direction.
Figure 3:
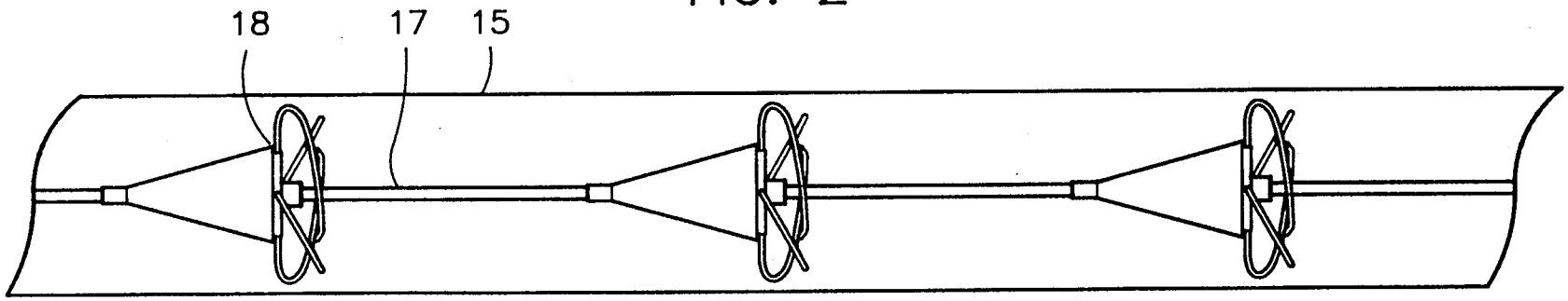
FIG. 3 illustrates the position of the scrapers when the rod is pushed against the air flow.

Referring to FIGS. 2 and 3, the length of the stroke 33 of the pull frame 20 is slightly longer than the spacing 32 of the cone-scraper assemblies 18. Hence, the downstream cone-scraper assembly 18 moves further than the upstream cone-scraper assembly's stop point, thereby collecting the dirt removed by the upstream cone-scraper 18, and providing the means to successively convey dirt outside the tube 15.

The cycling of the pull frame 20 during a few minutes per day is usually sufficient to clean the entire length of the tubes 15 and maintain maximum efficiency of the heat exchanger.

Figure 4:
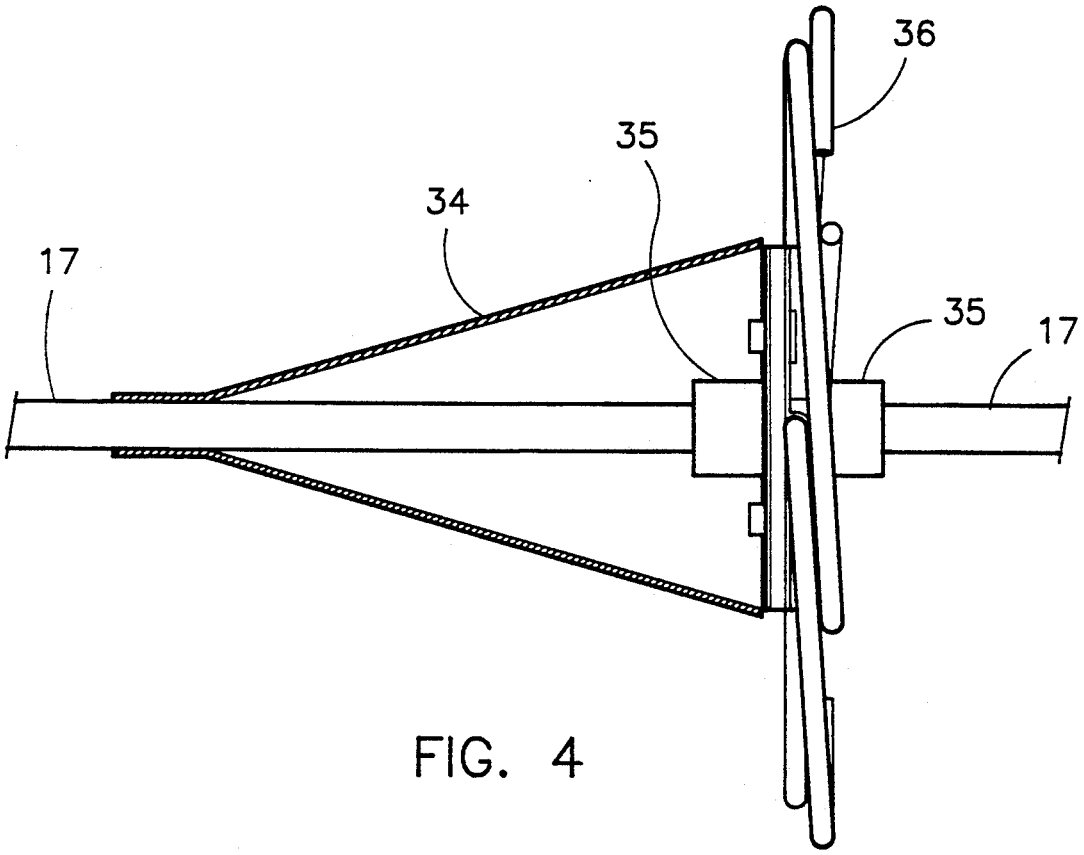
FIG. 4 shows a cross section of the cone and the mounting of the scraper on a pull rod.
Figure 5:
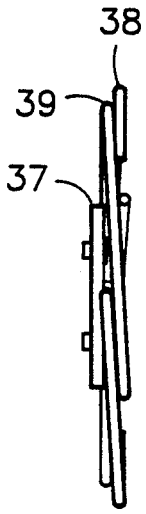
FIG. 5 shows a side view of a scraper in the expanded position.
Figure 6:
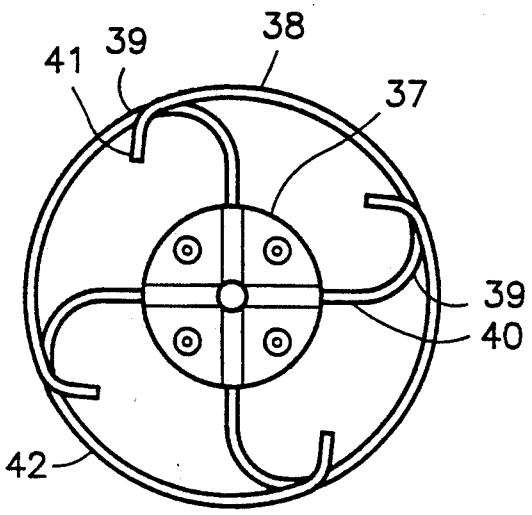
FIG. 6 shows a plan view of a scraper in the expanded position.
Figure 7:
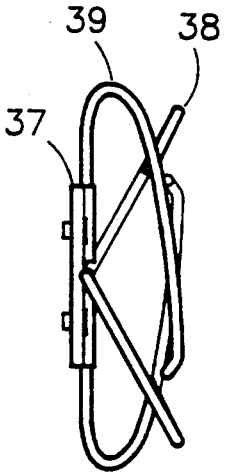
FIG. 7 shows a side view of a scraper in the contracted position.
Figure 8:
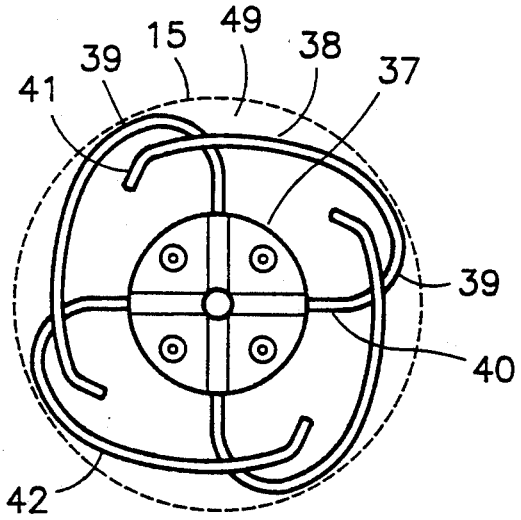
FIG. 8 shows a plan view of a scraper in the contracted position.

The cone-scraper assembly 18 as shown on FIG. 4 comprises a cone 34 and a scraper assembly 36. The cone 34 is glued or otherwise attached to the rod 17 at its small end. The scraper assembly 36 is held on the rod 17 in between two bushings 35, next to the large end of the cone 34.

As it can be seen on FIGS. 5, 6, 7 and 8, the scraper assembly 36 comprises a pivot disc 37 and four wires 42 pivotally and radially retained within the pivot disc 37 at 90° spacing.

Each wire 42 has a portion 38 bent according to the curvature of one quarter of the tube 15, and another portion 39 bent sharply and extending radially towards the central rod, thereby making a stem 40.

Figure 9:
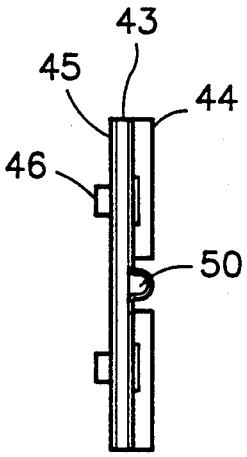
FIG. 9 illustrates a side view of a pivot disc.
Figure 10:
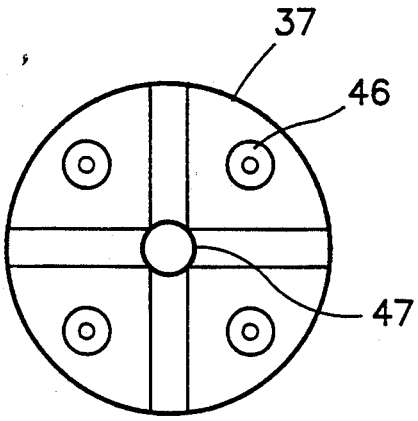
FIG. 10 illustrates a plan view of a pivot disc.

Referring to FIG. 9 and 10, the pivot disc 37 comprises a soft disc 43 made of a flexible material, between two rigid discs 44, 45. One of the rigid disc 44 is formed into four sockets 50, to receive the four stems 40 of wire 42. All 3 discs have a hole 47 at their centre for sliding on rod 17. All 3 discs are retained together by four rivets 46.

Figure 11:
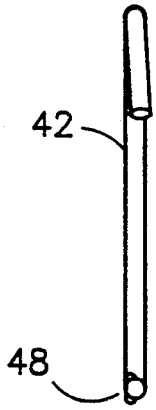
FIG. 11 is a side view of a scraping wire.
Figure 12:
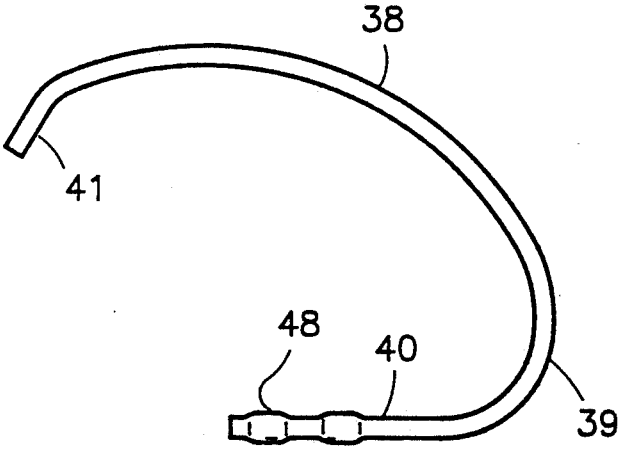
FIG. 12 is a plan view of a scraping wire.

The stem 40 of wire 42 has two flattened spots 48 within the plane of the wire 42, as illustrated on FIGS. 11 and 12. The flattened spots 48, resting against the soft disc 43, provide a restriction to excessive turning of the stem 40 within the socket 50.

Referring back to FIGS. 5, 6, 7 and 8, each wire 42 has a tail end 41 for overlapping over the sharp bend or shoulder 39 of the next wire, thereby interlocking all wires 42 in the expanded position for scrapping the entire surface of the tube when the scraper is pulled in the direction of the air flow.

The shoulder 39 and scraping portion 38 of wire 42 being in contact with the inside surface of the tube 15, and being at a distance from the turning axis of the stem 40, provide the leverage to rotate the stem 40 within the socket 50. The turning of the wires 42 in the direction of the air flow causes the scraping portion 38 to withdraw towards the centre of the tube 15 as shown on FIGS. 7 and 8. The withdrawing of wires 42 provide clearance 49 to overleap the deposit of the preceding scrapper assembly.

The shoulders 39 of the lower wires 42 being, because of gravity, always in contact with the surface of tube 15 provide leverage to rotate the stems 40 of the lower wires 42 during the expanding motion of the scraper.

The turning of one stem 40 is sufficient to cause the corresponding tail end 41 to push against the shoulder 39 of the next wire 42 causing this next wire to rotate also, and so on until the scraper is fully expanded.

This description of the invention shall not constitute a limitation in the scope of its applications. Also, it shall not constitute a limitation of the possible configuration of its element.

As examples, in some cases the variation of air velocity caused by the cones, and the reciprocating of the cones is sufficient to remove dust from the inside surface of the tubes. In those applications the scrapers are not used.

Conversely, in some other applications, cones are omitted because scrapers are sufficient to induce turbulence in the form of helical movement of the air.

The embodiments of the invention in which an exclusive property or privilege is claimed are defined as follows:

1. A heat exchanger for air comprising;

a bank of tubes through which warm air is blown, a casing with baffles, enclosing said bank of tubes such that fresh air to be heated is forced between all said tubes in two or more successive passes, a plurality of cones equally spaced on a rod inside each said tube, a plurality of collapsible tube scrapers, each said scraper being mounted on said rod, next to each said cone, a pull frame connecting all said rods, and a pull frame reciprocating means, having a reciprocating stroke length slightly longer than said spacing of said cones, said collapsible tube scraper comprising, a pivot disc having four sockets, extending radially from said rod, and being spaced at 90° apart, and four wires having each a stem pivotally retained within each said socket, a sharp bend next to said stem a scraping portion formed according to the curvature of one-quarter of the circumference of said tube, and a tail end making an obtuse angle with said scraping portion, each said wire being installed in said pivot disc such that each said tail end intersects with said sharp bend of said adjacent wire when said scraper is being pulled in the scraping direction.

2. A collapsible tube scraper comprising, a rod a pivot disc mounted on said rod, said pivot disc having four sockets, extending radially from said rod, and being spaced at 90° from one another, and four wires having each a stem pivotally retained within each said socket, a sharp bend next to said stem, a scraping portion formed according to the curvature of one-quarter of the circumference of said tube, and a tail end making an obtuse angle with said scraping portion, each said wire being installed in said pivot disc such that each said tail end intersects with said sharp bend of said adjacent wire when said scraper is being pulled in the scraping direction.

3. A collapsible tube scraper as claimed in claim 2, wherein said stem has at least one flattened spot providing a means to restrict excessive turning of said stem within said socket.

4. A collapsible tube scraper as claimed in claim 3, wherein said pivot disc has a surface made of a resilient material, operatively associated with said flattened spot to springily affect excessive withdrawing of said scraping portions.

5. A method of scraping an interior surface of a tube comprising;

providing a plurality of spaced-apart collapsible tube scrapers on a rod member, providing a rod member reciprocating means having a reciprocating length slightly longer than a spacing of said scrapers, placing said collapsible tube scrapers inside said tube, effecting movement of said tube scrapers in a first direction inside said tube while causing expansion of said scrapers to effect cleaning of said tube, and effecting movement of said tube scrapers in a return direction while causing collapsing of said scrapers to thereby overlap and avoid dirt left by a preceding scraper, whereby reciprocal movement of said tube scrapers successively conveys dirt out at one end of said tube.

6. A method of scraping an interior surface of a tube as defined in claim 6 wherein said collapsible tube scraper comprises, a rod mounting member, a plurality of scraping members each having, a mounting portion, a curved body portion, said curved body portion having a degree of curvature corresponding to a desired segment curvature of a tube to be cleaned, mounting means associated with said rod member, said mounting means including means for mounting a plurality of retaining means adapted to pivotally retain said mounting portion of a scraping member, whereby displacement of said scraper in said first direction, in association with rotation of said scraping member, causes each said curved body portion to be aligned in a plane substantially perpendicular to the longitudinal axis of said tube to thereby contact an interior surface of said tube, each said retaining means being angularly spaced such that a respective one of said scraping members cooperatively intersects with an adjacent one of said scraping members, thereby retaining a scraping position, and whereby displacement of said scraper in said return direction, in association with rotation of said scraping member, causes each said curved body portion to rotate away from said perpendicular plane, and hence to withdraw from said interior surface.

7. A method of scraping an interior surface of a tube as defined in claim 6 wherein said scraping member has a tail end portion forming an obtuse angle with said curved body portion such that said intersection of scraping members is nonparallel.

8. A method of scraping an interior surface of a tube as defined in claim 6 wherein said mounting portion has at least one flattened spot providing a means to restrict excessive turning of said mounting portion within said retaining means.

9. A method of scraping an interior surface of a tube as defined in claim 8 wherein said retaining means has a surface made of a resilient material, operatively associated with said flattened spot to springily affect excessive withdrawing of said scraping members.

* * * * *